US005935028A

United States Patent [19]

Lo

[11] Patent Number: 5,935,028

[45] Date of Patent: Aug. 10, 1999

[54] BADMINTON RACKET

[75] Inventor: Kun-Nan Lo, Taichung Hsien, Taiwan

[73] Assignee: Shenly Won Sport Co., Ltd., Miao Li, Taiwan

[21] Appl. No.: 09/128,976

[22] Filed: Aug. 4, 1998

[51] Int. Cl.[6] ..... A63B 49/10

[52] U.S. Cl. ..... 473/544; 473/535; 473/536; 473/547

[58] Field of Search ..... 473/535, 536, 473/544, 545, 547, 524, 537, 320, 319

[56] References Cited

U.S. PATENT DOCUMENTS

| | | | |
|---|---|---|---|
| 4,299,348 | 11/1981 | Fukumoto | 473/545 X |
| 4,436,305 | 3/1984 | Fernandez | 473/536 |
| 4,614,341 | 9/1986 | Fernandez | 473/536 |
| 5,088,735 | 2/1992 | Shigetoh | 473/320 |
| 5,516,100 | 5/1996 | Natsume | 473/535 |
| 5,575,881 | 11/1996 | Keester et al. | 473/536 X |

*Primary Examiner*—Raleigh W. Chiu
*Attorney, Agent, or Firm*—Browdy and Neimark

[57] ABSTRACT

A badminton racket is composed of an oval frame, a grip, and a shaft fastened between the oval frame and the grip. The shaft has a shell which is formed of a plurality of fiber-reinforced plastic layers and at least one metal gauze layer. The metal gauze layer is formed of a first metal filament and a second metal filament such that the first metal filament is extended in a direction forming an angle with the longitudinal axis of the shaft, and that the second metal filament is extended in a direction forming an angle with the longitudinal axis of the shaft. The angles so formed are preferably 60 degrees each.

6 Claims, 1 Drawing Sheet

BADMINTON RACKET

FIELD OF THE INVENTION

The present invention relates generally to a badminton racket, and more particularly to a badminton racket having a shaft which is formed of a fiber-reinforced plastic layer and a metal gauze.

BACKGROUND OF THE INVENTION

The conventional badminton rackets are generally made of a fiber-reinforced plastic material. In the process of making the conventional badminton rackets, the fiber reinforced material, such as carbon fiber or glass fiber, is first impregnated in the thermosetting resin, such as epoxy resin, to form a plate. A plurality of the plates are then stacked together and wound to form a tubular structure, which is then arranged in a molding tool. A badminton racket frame is formed in the molding tool which is heated under pressure. Such a badminton racket as formed is light in weight and is provided with an excellent elasticity; nevertheless it is not resistant to pressure. In addition, the shaft of the badminton racket is rather vulnerable to severance.

SUMMARY OF THE INVENTION

The primary objective of the present invention is therefore to provide an improved badminton racket free from the drawbacks of the conventional badminton rackets described above.

In keeping with the principle of the present invention, the foregoing objective of the present invention is attained by a badminton racket consisting of a shaft, an oval frame fastened with one end of the shaft, and a grip fastened with another end of the shaft. The shaft has a shell formed of a plurality of fiber-reinforced plastic layers and at least one metal gauze layer which is composed of two metal filaments such that one metal filament is extended in a direction forming an angle, $+\alpha°$, with the longitudinal axis of the shaft, and that another metal filament is extended in a direction forming with the longitudinal axis of the shaft an angle, $-\alpha°$, with the $\alpha$ being greater than zero degree and smaller than 90 degrees.

DETAILED DESCRIPTION OF THE INVENTION

Figure 1:
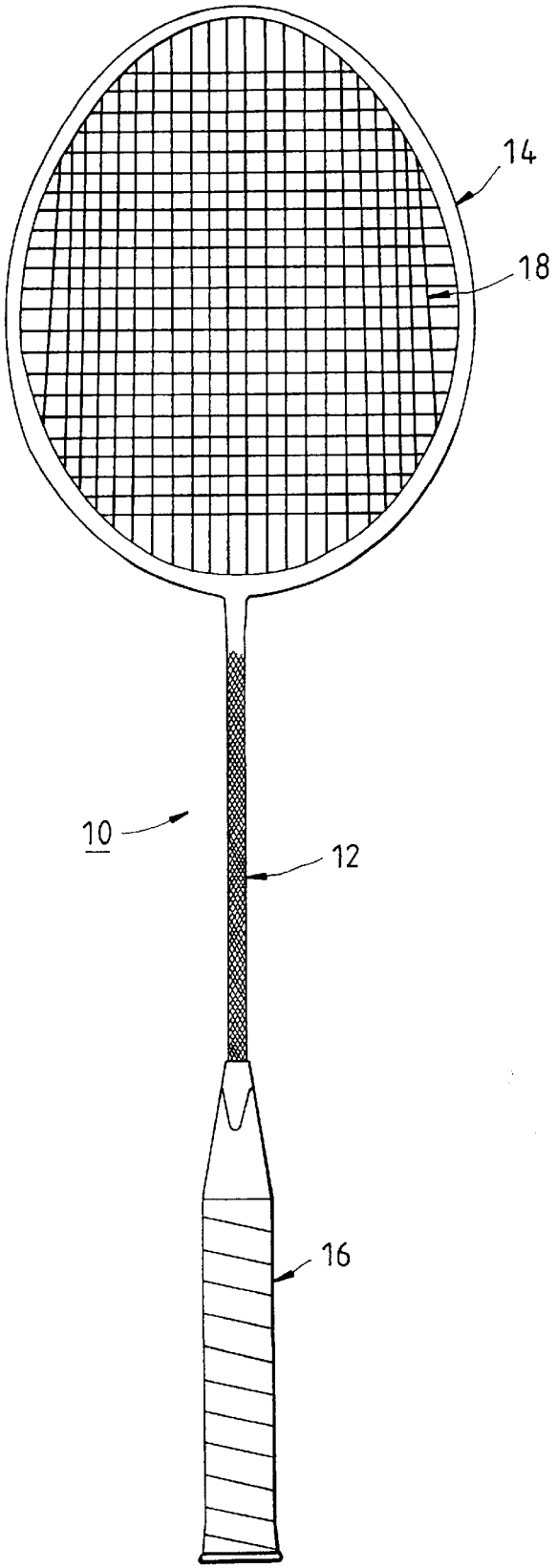
FIG. 1 shows a front view of a preferred embodiment of the present invention.
Figure 2:
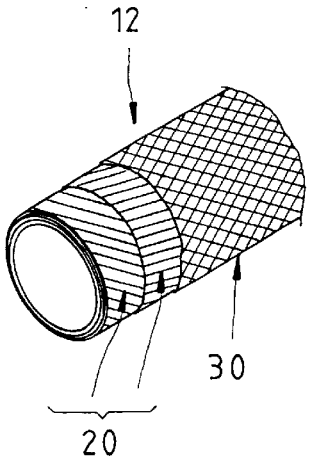
FIG. 2 shows a partial sectional view of the shaft of the preferred embodiment of the present invention.
Figure 3:
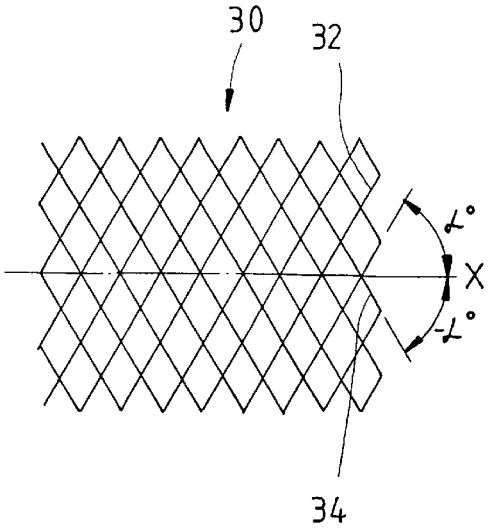
FIG. 3 shows a partial planar view of the metal gauze of the preferred embodiment of the present invention.

As shown in FIGS. 1–3, a badminton racket 10 embodied in the present invention is composed of a shaft 12, an oval frame 14 connected with one end of the shaft 12, and a grip 16 fastened with another end of the shaft 12. The oval frame 14 is provided with a surface 18 formed of string for hitting a shuttlecock.

The shaft 12 is tubular in shape and made integrally with the oval frame 14. The shaft 12 and the frame 14 are made of a plurality of carbon fiber sheets 20 impregnated with the epoxy resin. The carbon fiber sheets are composed of a plurality of carbon fibers which are arranged in a predetermined orientation. The carbon fiber sheets 20 are stacked together and then wound to form a tubular structure, which is subsequently wrapped by a metal gauze 30 before being arranged in a molding tool. The molding tool is heated under pressure such that the tubular structure takes form of a badminton racket.

The metal gauze 30 is formed of a first filament set 32 of titanium and a second filament set 34 of titanium. According to the results of tests done by this inventor of the present invention, it is suggested that a filament having an outer diameter between 0.02 mm and 0.05 mm be used if the shaft 12 has an outer diameter of 7.9 mm or less. In addition, the first filament set 32 is arranged in such a way that the first filament 32 is extended in a direction forming with a longitudinal axis X of the shaft 12 an angle of +60 degrees. In the meantime, the second filament 34 is extended in a direction forming with the longitudinal axis X of the shaft 12 an angle of −60 degrees. Moreover, the first filament 32 and the second filament 34 are arranged at an interval ranging between 1 mm and 1.5 mm. The shaft 12 is thus resistant to pressure and fatigue.

What is claimed is:

1. A badminton racket comprising:

a shaft;

an oval frame connected with one end of said shaft; and a grip fastened with another end of said shaft;

wherein said shaft has a shell formed of a plurality of fiber-reinforced plastic layers and at least one metal gauze layer, said metal gauze layer being formed of a first metal filament and a second metal filament such that said first metal filament is extended in a direction forming with a longitudinal axis of said shaft an angle of $+\alpha$, and that said second metal filament is extended in a direction forming with said longitudinal axis of said shaft an angle of $-\alpha$, said angle of $\alpha$ being greater than zero degree and smaller than 90 degrees.

2. The badminton racket as defined in claim 1, wherein said metal gauze layer forms an outermost layer of said shell of said shaft.

3. The badminton racket as defined in claim 1, wherein said first metal filament and said second metal filament are made of titanium.

4. The badminton racket as defined in claim 3, wherein said first metal filament and said second metal filament have an outer diameter ranging between 0.02 mm and 0.05 mm.

5. The badminton racket as defined in claim 4, wherein said first metal filament and said second metal filament are arranged at an interval ranging between 1 mm and 1.5 mm.

6. The badminton racket as defined in claim 1, wherein said angle of $\alpha$ is preferably 60 degrees.

* * * * *